United States Patent [19]

Dodds et al.

[11] 4,273,017

[45] Jun. 16, 1981

[54] PIANO ACTION KEYBOARD WITH ROLLER AND ELASTIC DIAPHRAGM TRANSDUCER

[75] Inventors: Philip V. W. Dodds, Needham; Mark L. Smith, Auburndale, both of Mass.

[73] Assignee: ARP Instruments, Inc., Lexington, Mass.

[21] Appl. No.: 15,729

[22] Filed: Feb. 27, 1979

[51] Int. Cl.[3] ..... G10H 1/02; G10H 1/34

[52] U.S. Cl. ..... 84/1.1; 84/1.27; 84/DIG. 7; 200/5 A; 200/16 A; 200/277; 340/365 A

[58] Field of Search ..... 84/1.04, 1.06, 1.09, 84/1.1, 1.14, 1.27, DIG. 7; 200/159 B, 277, 5 A, 16 R; 340/365 A

[56] References Cited

U.S. PATENT DOCUMENTS

| | | | |
|---|---|---|---|
| 3,694,606 | 9/1972 | Harris et al. | 200/159 B X |
| 3,854,018 | 12/1974 | Reynolds et al. | 200/5 A |
| 4,007,364 | 2/1977 | Ojima et al. | 200/5 A X |
| 4,044,642 | 8/1977 | Pearlman et al. | 84/1.1 |
| 4,217,803 | 8/1980 | Dodds | 84/1.1 |

*Primary Examiner*—Stanley J. Witkowski

*Attorney, Agent, or Firm*—Jerry Cohen

[57] ABSTRACT

A piano action keyboard for an electronic musical instrument or the like wipes a switch actuator (or other mechanical component of electric signal translation means) across switch contacts on a printed circuit board to generate signals indicative of the position and motionof a key when played. The keyboard provides a highly realistic piano "feel" through an array of paired depressable playing keys and arms. Each such arm supports a switch actuator or the like, with varying force transmission at different stages of depression of its corresponding key, the overall electrical-mechanical combination affording a response in terms of both actual results and kinesthetic feedback simulating a manual piano action.

6 Claims, 15 Drawing Figures

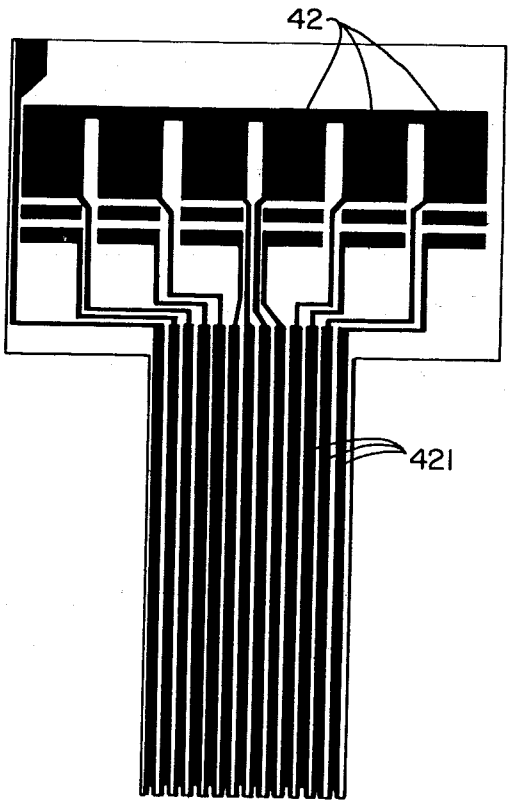
FIG. 6
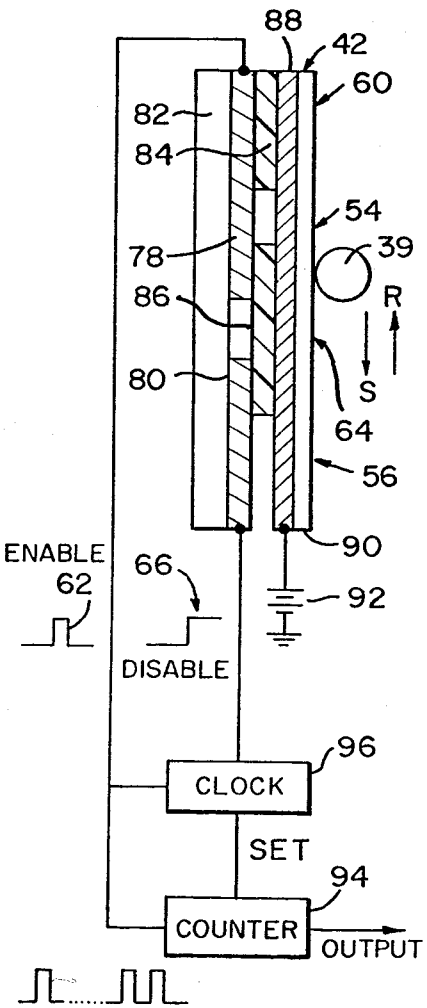
FIG. 5
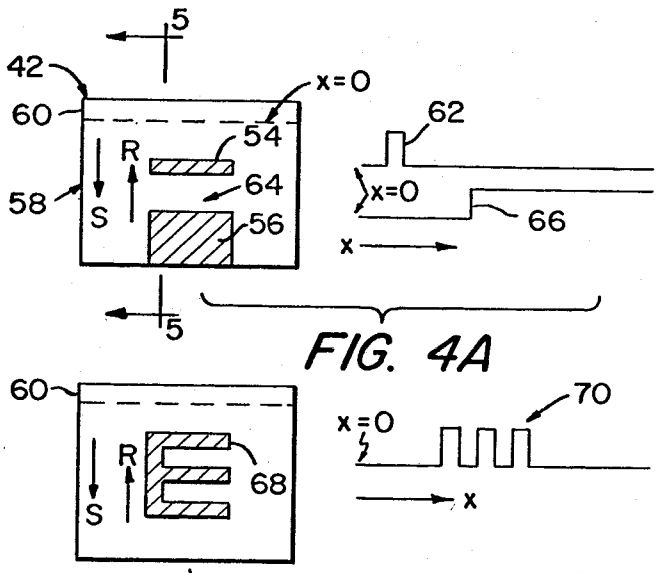
FIG. 4A
FIG. 4B
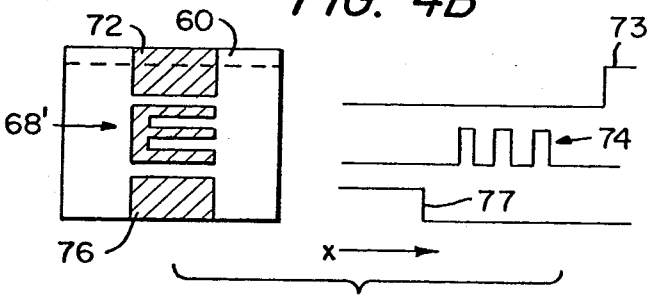
FIG. 4C

PIANO ACTION KEYBOARD WITH ROLLER AND ELASTIC DIAPHRAGM TRANSDUCER

BACKGROUND OF THE INVENTION

The invention relates to electrical switching and/or other electrical parameter changing by a mechanical translating element, particularly suitable for piano action keyboard for electronic musical instruments, characterized by a sensitive touch response or feel and practicality of high volume manufacture and utilization, having regard to considerations of reliability, effectiveness and cost.

It is a principal object of the invention to provide an electrical switching and/or other electrical parameter changing mechanism suitable for use in electronic musical instrument piano keyboard action described in the copending U.S. patent application of P. V. W. Dodds, Ser. No. 000,588, filed Jan. 2, 1979, now U.S. Pat. No. 4,217,803 granted Sept. 10, 1980, of common assignment with this application, and the disclosure of which including—background, objects, summary, drawing, description and claims—is incorporated herein by reference as though set out at length herein.

It is a further object of the invention to provide a switching and/or other electrical parameter changing mechanism assuring reliable contact with low actuating force applied by the mechanism and reliable contact break upon removal of the actuating force, to enable usability with a sensitive feel of the force applying linkage of the mechanism as described in said copending application consistent with the preceding object.

It is a further object of the invention to consistently apply a stable level (approximate) of actuating force and low dynamic friction consistently with one or more of the preceding objects and in the context thereof or in equivalent contexts.

As used hereinafter (unless otherwise stated), "electrical switching" refers broadly to electrical circuit making or breaking by closing or opening contacts and also to other forms of change in electrical circuits or electrical circuit analogues such as electromagnetic or magnetic pickups, Hall effect pickups, electrostatic pickups, capacitive pickups, rheostats, potentiometers or the like which can be used to make or break electric (or other) circuits or change a parameter thereof.

In accordance with the present invention, electrical switching is accomplished through use of multiple elongated electrical switching elements such as those of the elastomeric membrane type. Membrane type key switches are known for their low cost, consistent with reliability and have been utilized in touch-type keyboards for calculators and kitchen appliances. They typically have a conductive pattern on a board overlaid with a polyester film containing holes which is in turn overlaid by a conductive resilient sheet which can be pressed to penetrate under pressure and make contact with that portion of the conductive pattern underneath. Thus the switching element presents an elongated compliant surface (of the top elastomeric film). Finger and key pressures have been used to activate the compliance surface by pushing it down and therefore causing the conductive pattern underneath it to make contact with the basic conductive pattern on the board. In accordance with the present invention, providing an effective coupling with a piano action activating mechanism is practically accomplished through use of a resilient spring arm mounted on an end of the mechanism which is selectively moveable parallel to the elongated compliant surface and in turn mounting a roller element (spherical, cylindrical or other effective roller forms) on the spring end to maintain continuous contact with the elongated compliant surface with a force against the surface of 1–5 ozs., preferably 2 ozs., the force being established by the configuration of the spring transmitting activating force from the moving mechanism.

SUMMARY OF THE INVENTION

Such an activating mechanism usable for operation of electronic musical instruments (including pianos and in other contexts presenting equivalent needs in whole or in part), is formed from a linear array of depressable elongated playing keys, each pivotally mounted on a supporting base, and an array of elongated arms pivotally mounted on the base. Each arm has a forward end above and adjacent to a rear end of the key (keys and arms being arranged with substantially parallel elongation). In response to depression of a front end of any key to pivot it, the corresponding arm is moved by a force transmitted at an interface with the key. An electric signal means for the instrument includes fixed electrical circuit components behind the arms and compliant mechanical arms extending from the back of each arm to wipe across the fixed structure as the arm moves and thereby provide electrical signals indicative of the position of the key and velocity of key depression.

Each such arm has a weight distribution about its pivotal axis which acts in opposition to the force transmitted from a depressed key but continues inertial movement of the arm after key strike. Fixed stops intercept the heavily weighted arm portions. Restoring springs loaded by arm movement help return the arms to at-rest positions after key release and usually maintain key-arm contact. The spring force is overcome by the inertia of weight distribution to allow a sudden hard key strike to throw the arm into its extreme position beyond its key contact range (established by a key stop).

The spring arm carrying the roller is driven by the mechanism to sweep the roller across the switch element with a substantially constant normal force. The force is primarily tangential rather than normal to the switch element's compliant surface as the roller moves along it, such tangential force being only of sufficient magnitude to overcome friction and the normal force component being only as much as necessary to deform the contact layer. But the arrangement uniquely provides negligible effective reaction force to the actuating mechanism. Such reaction force as is transmitted back into the main actuating piano action linkage is negligible in relation to the forces involved in key strike and restoration of the linkage to its normal position.

The pattern of interaction of the movable roller and switching element tend to remain stable over a period of time, thus providing a consistent feel to the piano player who will be striking keys and expecting the same response to a given combination of speed and force elements in a key strike motion.

The compliant surface of the elongated switching element is placed at an angle of 50°–80° to horizontal, in a plus or a minus direction and the actuating mechanism has at least one link operating about a horizontal axis perpendicular from and substantially spaced from the traverse line along a switching element so that a substantially flat (small segment along a large radius) range of movement of significant length, half an inch or more, preferably over an inch, is provided for the roller carried on a spring at the working end of the actuating mechanism. This arrangement provides a high tolerance of spacing of different active and inactive portions of the switching element, while maintaining substantially constant normal force applied by the wheel, consistent with a practical actuating mechanism.

These and other objects, features and advantages of the invention will be apparent from the following detailed description with reference therein to the accompanying drawing in which:

BRIEF DESCRIPTION OF THE DRAWING

FIGS. 4A–4C are planar views of a number of alternative embodiments of the electrical switching elements in which FIG. 4A shows a contact configuration in which two discrete pulses are generated as the switch actuator contacts either element, FIG. 4B shows a configuration in which a pulse train is generated on a single output line, and FIG. 4C shows a configuration having an added upper and lower contact;

FIG. 5 shows a detail of the switchboard and a simple utilization circuit for measurement of arm's velocity.

FIG. 6 is a plan view of a number of the FIG. 4A switches in a portion of the switchboard.

DETAILED DESCRIPTION OF PREFERRED EMBODIMENTS

Figure 2:
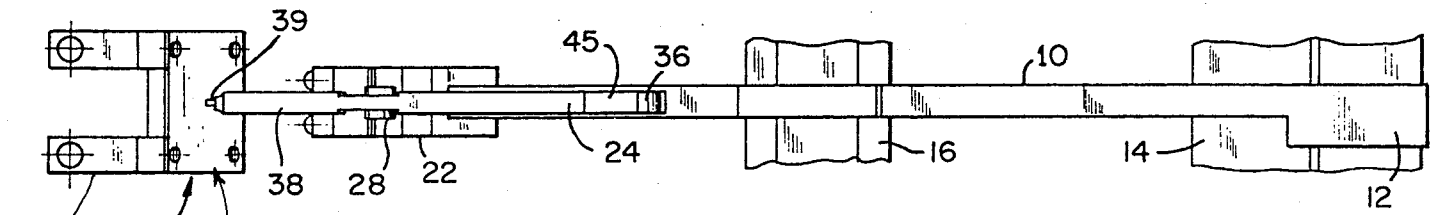
FIG. 1 is a side view of a single key arm/electrical signal output device combination of a keyboard and typical of all such combinations in the keyboard linear array and FIG. 2 is a corresponding top view (a dash line alternate position is also seen)
Figure 1:
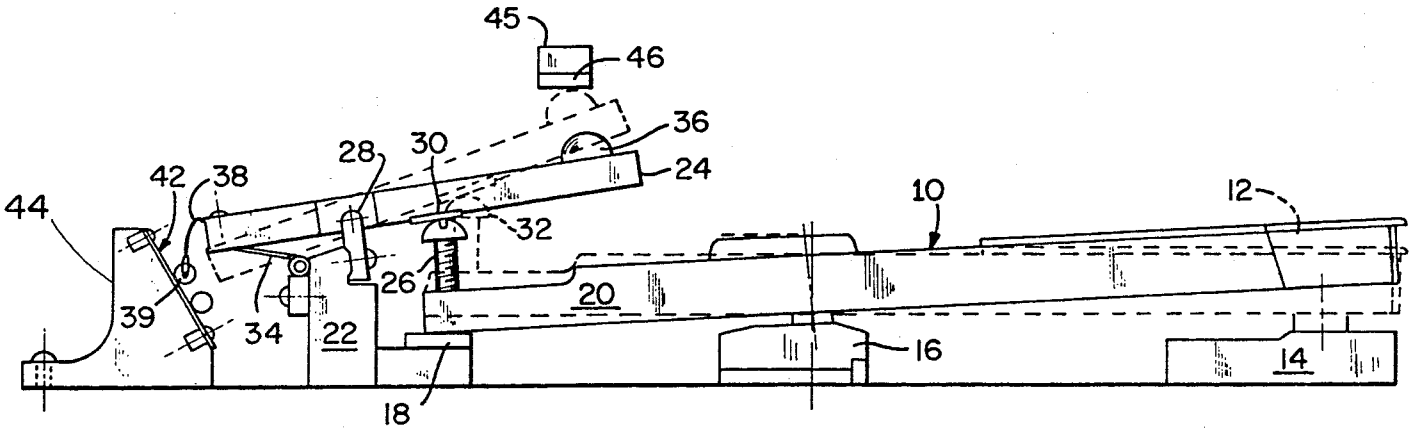

Referring now to FIGS. 1 and 2, an elongated key 10 having a playing end 12 and a front punching 14 mounted thereunder is mounted for depression by a player. The key 110 rotates about a rail 16 and has a back cloth 18 mounted under a back end 20 of the key. Mounted adjacent the back end 20 of the key is the flange 22 supported from a fixed base and on which flange an arm 24 is mounted. A jack 26 may extend downward from the arm or upward from the key as shown (preferably the latter). The arm is pivotally mounted by means of a fixed pivot 28. A key pad 30 mounted on the rear end 20 of the arms meets the upper surface 32 of the jack 26. The flange 22 supports one end of a spring 34 which extends along the arm (rear) end remote from the flange 22. A spring arm 38 is mounted on the rear arm end, extends beyond the end of the hammer arm 24 and has a roller 39 mounted on its remote end. A switchboard 40 carrying an upper pressure sensitive layer 42 upon which the roller 39 presses is mounted on a lower frame 44. An upper frame 45 carries an arm stop 46 which limits the travel of the arm 24.

When the playing end 12 of the key 10 is depressed, the key pivots about the rail 16 and lifts jack 26 to thereby rotate the arm 24 about pivot 28. This causes the roller 39 to wipe downwardly across the switchboard in direct response to the motion of the arm 24. Although the weight 36 may contact the arm stop 46 at maximum travel, key travel is limited by the key contacting the front punching 14 when depressed.

The added weight 36 (or an equivalent weight distribution within the arm) greatly contributes to the desired piano action feel by providing an inertial force to the arm 24 which continues the motion of the arm in response to a brief but forceful key depression. This contributes to achieving the response of a grand piano action without the complexity of such an action. Control over wide dynamic range is provided by the above features.

Unlike a conventional piano action in which a hammer mechanism actually strikes a string to cause onset of a note, the piano action keyboard for an electronic musical instrument need only impart a characteristic piano-action feel and response to the keys. Mechanically, this allows it to be greatly simplified, but electrically it must interface with circuitry which controls and generates the parameters necessary for operation of an electronic music instrument (e.g., a synthesizer). This electromechanical interface is preferably provided by the switch elements. Any mechanical friction existent in the electromechanical interface will be "reflected" in the feel of the key action. Since it is an object of the present invention to provide a realistic key feel and response, it is important that such friction be minimized.

One preferred form of the switch elements comprises a spring arm 38 and roller 39 mounted at the end of the arm remote from the pivoted end and a plurality of switch elements mounted on a switchboard 40 positioned tangential to the flight of the spring arm so as to remain in contact with the roller 39 through the entire arc which the arm 24 travels. The sliding friction which would normally exist if the spring arm 38 directly wiped the switchboard 40 is converted to rolling friction by roller 39. This roller reduces the overall drag that would otherwise exist in the keyboard response and substantially improves the restrike characteristics. Switch elements within the switchboard 36 within this arc are utilized to implement a number of alternative embodiments for position and motion measurements.

Figure 3A:
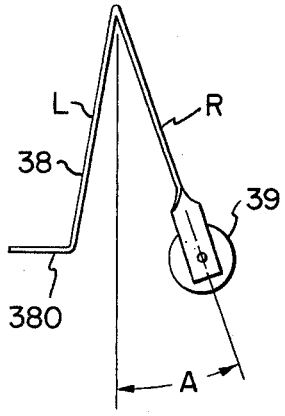
FIGS. 3A–3C are side, front and top views of a coupling between the mechanism and electrical switching element in accordance with a preferred embodiment of the invention
Figure 3B:
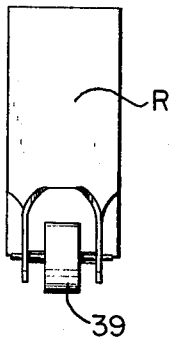
Figure 3C:
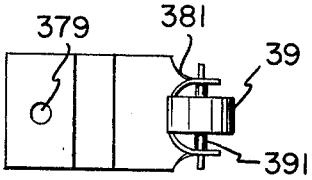
Figure 3D:
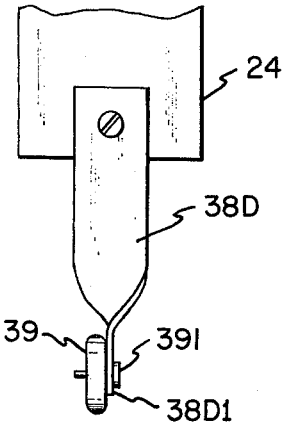
FIG. 3D shows a front view of a variant embodiment.

Expanded side, front and top views of spring 38 and roller 39 are shown in FIGS. 3A–3C respectively and a front view of a variant embodiment of this coupling is shown in FIG. 3D. The roller 39 is mounted on trunnions 391 which are supported by bent ears 381 located at the end of a sheet spring element 38 of vee-bent form. The integral nature of spring element 38 avoids the need to accommodate tolerances in mating parts. While two ears are provided straddling a roller in FIGS. 3A–3C, the arrangement can be as simple as an end twist to form a single ear 38D1 (at the end of a spring element 38D which is not of vee-bent form but gets its resilience from a simple curvature or deflecting arrangement with respect to the switch element). The FIGS. 3A–3C embodiment is preferred in relation to the FIG. 3D embodiment. A bent end portion of the spring 38, 380, is mateable to the actuating arm of the actuating mechanism by bolting thereto (by a bolt or other fastener passed through a hole 379 in the tab 380). Typical dimensions of the left arm L and right arm R of the vee-bent spring 38 are 0.844 and 1.00 inches respectively and a typical angle A is 15°. The roller 39 is typically a one-quarter inch diameter by 0.063 inch wide cylindrical element.

Figure 3E:
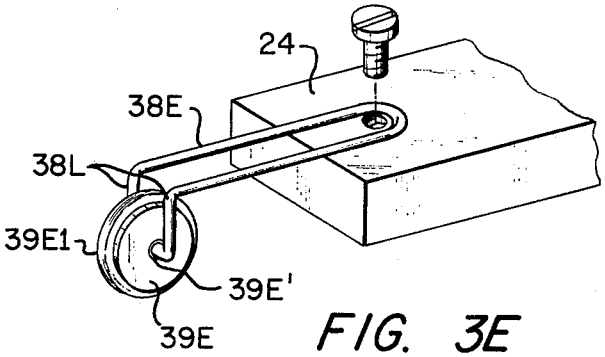
FIGS. 3E–3H show further variants.
Figure 3F:
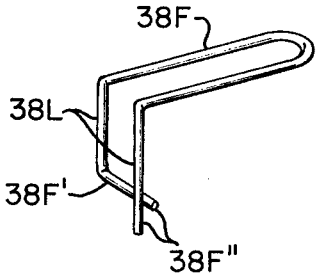
Figure 3G:
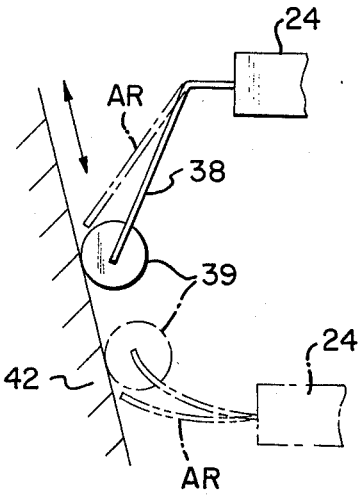
Figure 3H:
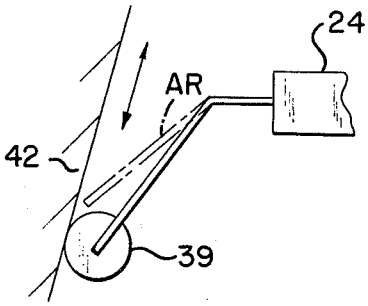

FIG. 3E shows a spring element 38E of wire form typically 0.023 inch diameter brass spring wire) which can be fastened by a screw as indicated in exploded form—to arm 24 and used to hold a roller 39E with a dished edge carrying a rubber (or plastic) O-ring 39E1. The wire passes through a central hole 39E' in the wheel and may have loose ends there or may be fastened into a closed loop (with the fastening point between two wire ends at any point along the wire length. FIG. 3F shows a variant of the FIG. 3E embodiment wherein a wire 38F of paper dip form wherein a wire 38F of paper clip form is used. End 38F' passes through the hole in the wheel 39E (FIG. 3E) and end portions 38F'' are twisted (and excess length portions thereof may be cut off). The legs 38L can ride against wheel sides to restrain twisting of the wheel. FIGS. 3G and 3H show that the switch 42 acute angle face can be at positive or negative acute angles and that the bend of spring arm 38 (of any of the variant forms above) can be upwards or downwards from a basic at rest position AR of the spring arm.

FIGS. 4A–4C are planar views of various forms of contact boards useful in the invention. A preferred embodiment of the switchboard contact elements is shown in FIG. 4A and comprises a narrow first contact 54 and a second contact 56 spaced from the first contact, both mounted on a substrate 58; the roller initially (i.e., at its rest position) contacts the PC board 58 at the position indicated by line 60. In its rest position, as the spring arm falls upon depression of a key, the roller crosses contact 54, developing an initial narrow pulse 62. It then passes across non-contact area 64 and finally touches contact 56 which develops a pulse 66 which remains "on" as long as the spring arm stays in the up position corresponding to the "key depressed" state. Arrows S and R indicate roller 39 motions on key strike and release. This configuration can provide significant information when interfaced with appropriate electronic circuitry. Since the first contact 54 is spaced below the rest position 60 of the spring arm, initial accelerations required to overcome gravity and mechanism friction have decreased by the time the spring arm crosses the first contact. The time between the falling edge of the first contact pulse 62 and the onset of the second contact pulse 66 is indicative of the velocity of key/spring travel. By attenuating initial irregularities in spring arm velocity, the measurement of this time becomes more repeatable for successive keystrokes. Partial release of a key brings the spring arm above the second contact thereby indicating key release. If the spring arm is allowed to at least touch the first contact area 54 before it again falls (due to key depression) to touch the second contact 54, the piano-action "restrike" characteristic is closely simulated.

An alternative contact scheme is shown in FIG. 4B. As the spring arm travels across the contact board 68, a series of pulses is generated. Iterative time measurements taken on this pulse then give "incremental", as well as average, velocity. FIG. 4C is a second pulse train contact layout utilizing two additional contacts. An upper contact 72 remains "on" (73) until key depression begins. A pulse train 74 is then generated as described previously. A lower contact 76 then goes "on" (77) as the key reaches its maximum travel. Using this contact pattern, discrete events can be triggered at the beginning and end of key depression in addition to generating signals indicative of key velocity. For example, one of the intermediate pulses may be used to trigger a modifier, such as a sample-hold circuit for varying timbre. Also the final pulse, corresponding to the key being held down, can be used to control an "on-off" instrumental effect which is independent of key velocity. This can be useful in achieving a "layered" musical effect, with an "orchestral quality."

Since a plurality of algorithms exist for measurement of key strike velocity, it is important that an improved piano action for an electronic musical instrument have an electromechanical interface flexible enough to meet the varying requirements of these different methods.

The preferred embodiment of the "contact" previously described is a modified version of a commercially available "membrane" or "touch" type switch. FIG. 5 is a cross sectional elevation view of the switchboard of FIG. 4A. Two conductive pads 78 and 80 are mounted on an insulating substrate 82. Spacers 84 and 86 are mounted to physically separate the conductive pads 78 and 80 from the lower conductive surface 88 of the flexible switch plate 90. In operation, as the roller passes over area 54, the switch plate 90 flexes downward causing conductive layer 88 to contact pad 78, thereby creating a closed circuit. When the roller is over area 64, no contact is made due to the insulating spacer 86. Contact is made between the pad 80 and the conductive layer 88 when the roller depresses the switch plate 90 over area 56. A voltage source 92 is connected to the conductive layer 88 thereby generating voltage changes as the pads 78 and 80 are contacted. The top film is sufficiently resilient and tensioned to bounce back to a rest state without hunting when deflecting force is removed therefrom and in less time that it takes to return deflecting force to the opening.

An embodiment of utilization circuitry is also shown in FIG. 5. The positive-going edge of the pulse 62 resets a counter 94 to its maximum value. The negative-going edge of pulse 62 enables a high frequency clock 96 which begins decrementing the value in the counter. This decrementing continues until the positive-going edge of pulse 66 disables the clock thereby effectively "freezing" the final value in the counter. This final value is stored and used as a relative amplitude voltage to control an electronic musical instrument. The lower the velocity of key depression, the longer the time between first contact pulse and second contact pulse, and correspondingly, the smaller the final value output. Should the time between first and second pulses be long enough to allow complete decay from the maximum value, the output would be zero. This corresponds to a very slow key depression and, as in a true piano action, there exists a lower key strike threshold below which no sound is generated.

In an alternative optional embodiment, provision may be made to have some non-zero value of output corresponding to a very slow key depression. Although this is not characteristic of the response of a true piano action, it would be of considerable aid to musicians attempting to achieve an extremely soft "pianissimo" effect without the problem of some notes not sounding at all.

FIG. 6 shows the patterning of a typical array of the elastomeric switching elements 42 and leads 421 extending thereto. The leads 421 and switching elements are all commonly encapsulated or wrapped within plastic film for protection against adverse atmospheric conditions, dust and other factors which would interfere with the integrity of the circuit arrangement.

Variations from the above described preferred embodiments, meeting one or more of the objects of the invention and within the broadest scope thereof include, without limitation, capacitance or resistance change transducers in lieu of normally on or normally off switches; optical-mechanical pickups in lieu of electromechanical pickups; electromagnetic or magnetic pickups, or Hall effect pickups, in lieu of electromechanical pickups; multiple arms associated with each key (i.e., addition of intermediate arms between key and switch-carrying arm); and usage of the keyboards hereof in non-musical applications (e.g., graphics, computer or communication machine consoles).

It is evident that those skilled in the art, once given the benefit of the foregoing disclosure, may now make numerous other uses and modifications of, and departures from the specific embodiments described herein without departing from the inventive concepts. Consequently, the invention is to be construed as embracing each and every novel feature and novel combination of features present in, or possessed by, the apparatus and techniques herein disclosed and limited solely by the scope and spirit of the appended claims.

What is claimed is:

1. Electrical circuit controller usable in electric musical instrument keyboard controls and like applications responsive to a plurality of independent controlling movements comprising, means defining a circuit portion comprising at least a triple layering of bottom, middle and top superimposed films of resilient plastic, the middle such film having multiple openings therein in a linear array, the films being tensioned and arranged so that portions of the bottom and top films have two relative positions, one of which is close proximity including contact or near contact of the two films and the other of which is lesser proximity, one of said positions being the at-rest position of the films portions in the region of each such opening and the other being the result of external actuation to at least one of the films, the positional changes of film portions in other openings of said aperture array being similarly sequentially effected, the film arrangement at each such opening including a capability of varying the form or time of assuming a form of the said films resulting from the application of external force depending on the exact point of application force and rate of application of the said external actuation, means defining electrical components located in at said openings and each having multiple states in relation to an electrical circuit containing such components including at least a first state when the top and bottom films have said at rest positions and a second state in the other position and including in at least some of said openings, a third state resulting from variation of form of the said position due to variation of location, force and rate of said external actuation, and means defining a separate external force actuating linkage aligned with each opening of the linear array and arranged for independent actuation of the film portions at each such opening.

2. Electrical circuit controller in accordance with claim 1 and further comprising similar superimposed film arrangement and collateral openings thereof with circuit elements therein located adjacent at least some of the openings of said linear array but out of the linear array, at least some of said actuating linkages being arranged to move between one of the openings of said linear array and at least one of said collateral aperature regions for selectively actuating the circuit components therein to change the state thereof.

3. Electrical circuit controller in accordance with either of claims 1 or 2 wherein the actuating linkage comprises carrier means spaced from said top film and movable parallel thereto, a roller for moving along the top film and compliant support means supporting the roller from the carrier and holding it adjacent the top film with sufficient force so that the roller deflects the top film when over one of said openings and does not deflect it when over the three superimposed films, the top film being sufficiently resilient and tensioned to bounce back to at rest state without hunting when deflecting force is removed therefrom and in less time that it takes to return deflecting force to the opening.

4. A piano action keyboard for an electronic musical instrument comprising a plurality of elongated keys each of which is pivotally mounted on a supporting base, a plurality of hammer-like arms pivotally mounted on said base, each arm being adjacent one end of a key and arranged so that when the key is pivoted, a driving force is imparted to the adjacent arm by direct striking of the arm by the key in a strike region, electrical signal means comprising an elongated member with an elongated compliant surface and an actuating coupling mounted on each said pivoted-arm and plural portions of said signal means each of which is responsive to movement of one said arm to deflect different portions of the compliant surface to generate electrical switching signals as the associated arm moves, including response to rate of movement of the arm and to travel of the arm, the actuating coupling comprising a spring carrier mounted on each arm as a cantilever extension thereof and a roller mounted from the spring in contact with the compliant surface, a spring means mounted on said base and connected to each arm to apply to each such arm, when loaded by a corresponding key strike and resultant transmission of force to the arm, a restoring force in opposition to the force so applied, means pivotally mounting each such arm, the said strike region and distribution of weight of each arm being arranged so that the weight distribution applies an inertial force (as an unbalanced net weight) on said arm in opposition to the force applied to the arm by the key, the combination of spring action and weight affording a kinesthetic feedback to the keys simulating that of a manual piano without interference from the coupling, whereby the roller maintains continuous contact with the compliant surface moving with low friction and tracks thereon in response to different arm motions with substantially constant force applied against said surface by the roller.

5. A piano action keyboard according to claim 4 wherein the arms are aligned substantially parallel to their respective keys and all pivotally mounted in an array with forward ends of the arms overlying back ends of the keys, the keys being pivotally mounted at intermediate positions thereof, the said electrical signal means comprising an array of switches lined up behind the said arms, each arm mounting on its back end, as said mechanical component of the signal means, a link which will act on one of said switches as the arm is removed in response to striking by the key, the range of motion of the said arm including a portion where the arm remains in contact with its actuating key and a portion where the arm can be out of contact with its activating key, the electrical signal means having distinctly different responses to movement of the said arm in said different portions.

6. A piano action keyboard according to claim 4 wherein the signal means are constructed and arranged so that initial arm movement is ineffective to generate a signal, and subsequent movement is so effective, whereby the effect of initial accelerations of the key-arm mechanism output is attenuated.

* * * * *